US005655428A

United States Patent [19]

Cockburn et al.

[11] Patent Number: 5,655,428

[45] Date of Patent: Aug. 12, 1997

[54] FOOD SLICING APPARATUS

[75] Inventors: Robert G. Cockburn, Ulverstone; Owen M. Porteus, Smithton, both of Australia

[73] Assignee: McCain Foods (Aust) Pty. Ltd., Smithton

[21] Appl. No.: 510,330

[22] Filed: Aug. 2, 1995

(Under 37 CFR 1.47)

Related U.S. Application Data

[63] Continuation of Ser. No. 134,967, Oct. 12, 1993, abandoned.

[30] Foreign Application Priority Data

Oct. 16, 1992 [AU] Australia ..... PL5313

[51] Int. Cl.[6] ..... B26D 1/03

[52] U.S. Cl. ..... 83/857; 83/402

[58] Field of Search ..... 83/857, 932, 856, 83/402

[56] References Cited

U.S. PATENT DOCUMENTS

| | | | |
|---|---|---|---|
| 1,910,380 | 5/1933 | Daum . | |
| 2,150,735 | 3/1939 | Williams et al. | 146/163 |
| 2,487,431 | 11/1949 | Floyd | 146/169 |
| 3,109,468 | 11/1963 | Lamb et al. . | |
| 4,059,037 | 11/1977 | Gerson et al. | 83/857 |
| 4,275,086 | 6/1981 | Brown et al. . | |
| 4,300,429 | 11/1981 | Brown et al. . | |
| 4,372,184 | 2/1983 | Fisher et al. . | |
| 4,766,793 | 8/1988 | Fischer et al. | 83/402 |
| 5,009,141 | 4/1991 | Julian et al. . | |
| 5,046,388 | 9/1991 | Mendenhall | 83/402 |
| 5,058,478 | 10/1991 | Mendenhall | 83/857 |
| 5,101,718 | 4/1992 | Lin | 83/857 |
| 5,125,308 | 6/1992 | Mendenhall | 83/857 |

FOREIGN PATENT DOCUMENTS

| | | |
|---|---|---|
| 8700507 | 10/1988 | Netherlands . |
| 2130473 | 6/1984 | United Kingdom . |
| WO89/07039 | 8/1989 | WIPO . |

*Primary Examiner*—Kenneth E. Peterson

*Attorney, Agent, or Firm*—Seyfarth, Shaw, Fairweather & Geraldson

[57] ABSTRACT

The food slicing apparatus comprises a tube through which the vegetables pass. Extending through the tube are four sets of blades all at the same acute angle to the path of the vegetables. The blades in the first and second sets lie in parallel planes and the blades in the third and fourth sets also lie in parallel planes which are perpendicular to the planes containing the first and second sets. The angles of the blades in the first and second sets are of opposite polarity and the angles of the blades in the third and fourth sets are of opposite polarity. The leading portion of one blade and the trailing portion of the adjacent blade overlap.

20 Claims, 4 Drawing Sheets

FOOD SLICING APPARATUS

This application is a continuation of application Ser. No. 08/134,967, filed Oct. 12, 1993, now abandoned.

BACKGROUND OF THE INVENTION

1. Field of the Invention

This invention relates to an apparatus to slice potatoes and other vegetables into strips.

2. Description of the Prior Art

A common method of cutting potato strips to make french fries involves entraining the potatoes into a fast-moving water carrier which propels the potatoes against a set of knives or blades arranged into a grid. The spacing between adjacent blades corresponds to the cross section of the potato strip desired to be produced. It is known to incline the blades to the path of the potatoes to improve performance. For example, Dutch patent specification no. 8700507 discloses such a slicing apparatus. U.S. Pat. No. 5,009,141 uses blades of chevron configuration. These slicing apparatuses suffer the disadvantage of creating turbulence of the water carrier in the slicing apparatus. In other words, water moves not only along the desired path, but also transversely to it. Such turbulence tends to move the potato slightly transversely as it moves through the slicing apparatus, thereby creating a transverse component of the cuts. The result are strips that are more ragged than desired. Also, breakage occurs in the strips during cutting or thereafter. Also, prior slicing apparatuses including inclined blades cause shattering of the potato because a line of breakage tends to proceed in front of the actual cut of the potato.

Finally, the configuration of the slicing apparatus in the Dutch patent is such as to tend to cause the potato to veer somewhat from the perfect, desired path of travel, as it passes through the slicing apparatus.

SUMMARY OF THE INVENTION

It is, therefore, an important object of the present invention to reduce transverse movement of the potato and the water as they pass through the slicing apparatus.

Another object is to provide a food slicing apparatus that reduces the tendency of the potato to break off in advance of the actual cut.

Another object is to reduce the tendency of the potatoes to veer from the desired, longitudinal path as they pass through the slicing apparatus.

Another object is to reduce the tendency of the slicing apparatus to shatter the potatoes.

In summary, there is provided a food slicing apparatus for slicing vegetables into strips, the vegetables moving through the apparatus along a predetermined path, the apparatus comprising a plurality of elongated blades at an acute angle to the path, the blades lying in substantially parallel planes, each of the blades having leading and trailing portions and each of the leading portions terminating in a sharpened leading edge, the leading and trailing portions of at least one pair of adjacent ones of the blades overlapping.

In another aspect of the invention, the slicing apparatus included a tube, the axis of which is collinear with the path of the potatoes.

In another aspect of the invention, some blades are at a positive acute angle to the path, others are at a negative acute angle to the path, these blades lying in substantially parallel first planes, still other blades are at second planes substantially perpendicular to the first planes, some of which are at an acute positive angle to the path, and the rest of which are at an acute negative angle to the path.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
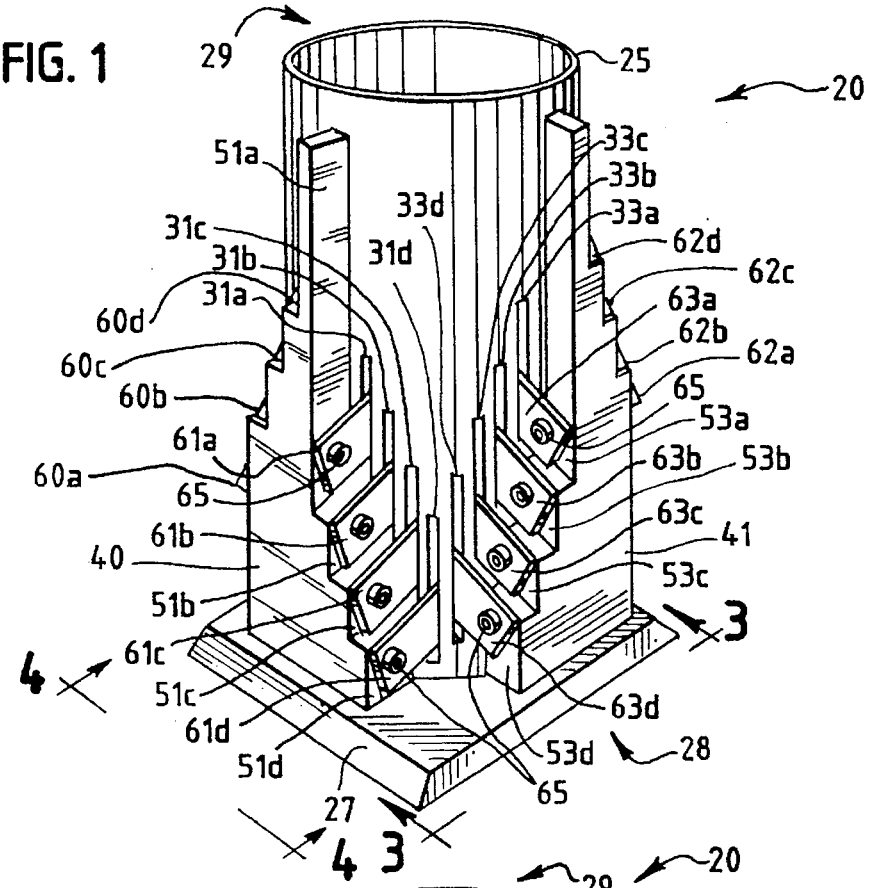
FIG. 1 is a perspective view of a vegetable slicing apparatus incorporating the features of the present invention.

Referring to the drawings, there is depicted a slicing apparatus 20 for particular use in slicing potatoes into strips for use in making "french fries" or similar product. It is to be understood that slicing apparatus 20 has applicability to slicing other kinds of vegetables into strips. Slicing apparatus 20 includes a plurality of blades arranged in a grid that receive potatoes from what is commonly referred to as a "gun" (not shown). Potatoes are launched one at a time with force against the slicing apparatus. Preferably, the potatoes are entrained in a liquid such as water and moved by a large pump along a predetermined substantially straight path 21 (FIGS. 3, 4) toward slicing apparatus 20 entering at upstream end 28 and exiting at downstream end 29.

Figure 6:
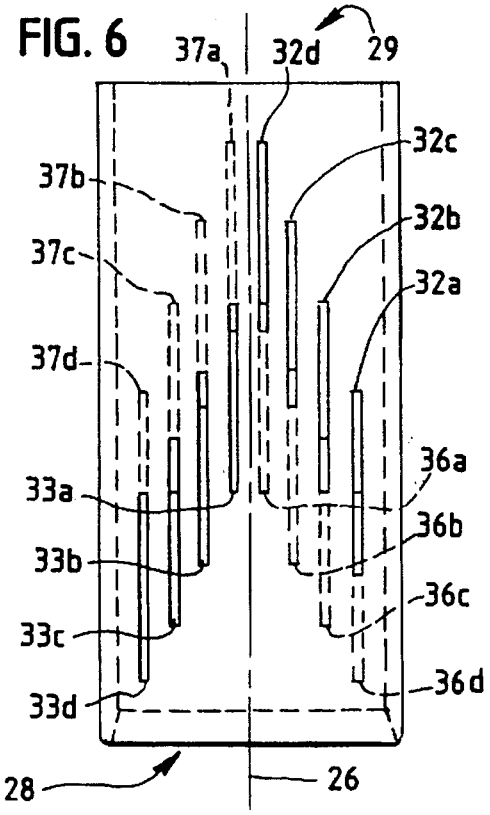
FIG. 6 is an elevational view of the tube.
Figure 7:
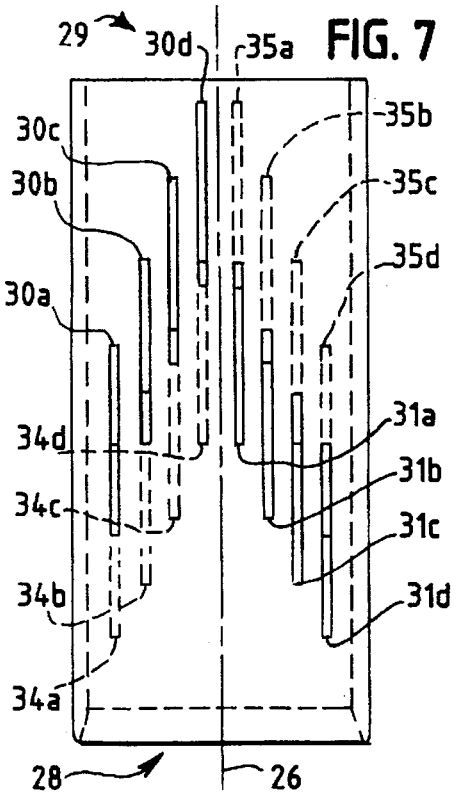
FIG. 7 is an elevational view of the tube taken at a point 90° removed from FIG. 6.

Slicing apparatus 20 comprises a central tube 25 having an inside diameter slightly larger than the cross dimension of the potatoes being processed by apparatus 20. In a particular example, tube 25 had an inside diameter of 90 mm. Tube 25 has a cylindrical axis 26 that is collinear with predetermined path 21 of the potatoes. Tube 25 is attached to a base 27 having a central opening. Referring specifically to FIGS. 6 and 7, tube 25 has eight sets of longitudinally extending slits 30*a–d* to 37*a–d* parallel to axis 26. Each slit on one side is laterally aligned with a slit on the opposite side. Thus, for example, slit 30*a* on one side of tube 25 is aligned with slit 34*a* on the other side of the tube, and slit 31*a* on one side of tube 25 is aligned with a slit 35*a* on its other side. Similarly, for example, slits 33*d* and 37*d* on opposite sides are aligned and slits 36*b* and 32*b* on opposite sides are aligned. A blade extends through aligned pairs of slits as will be described.

Figure 2:
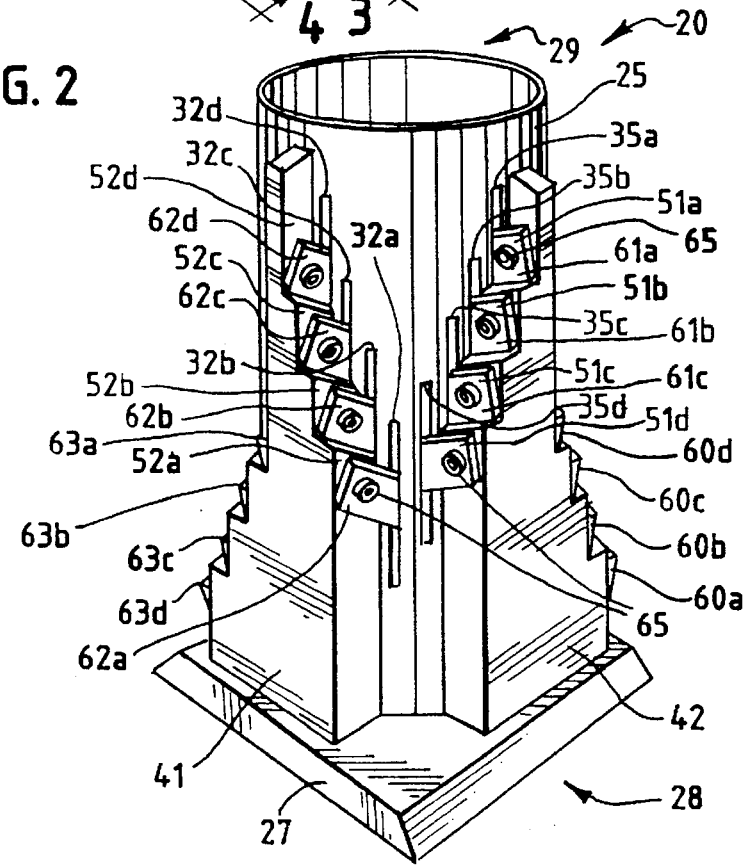
FIG. 2 is a perspective view of the vegetable slicing apparatus of FIG. 1, but taken at a point 90° removed from FIG. 1.
Figure 5:
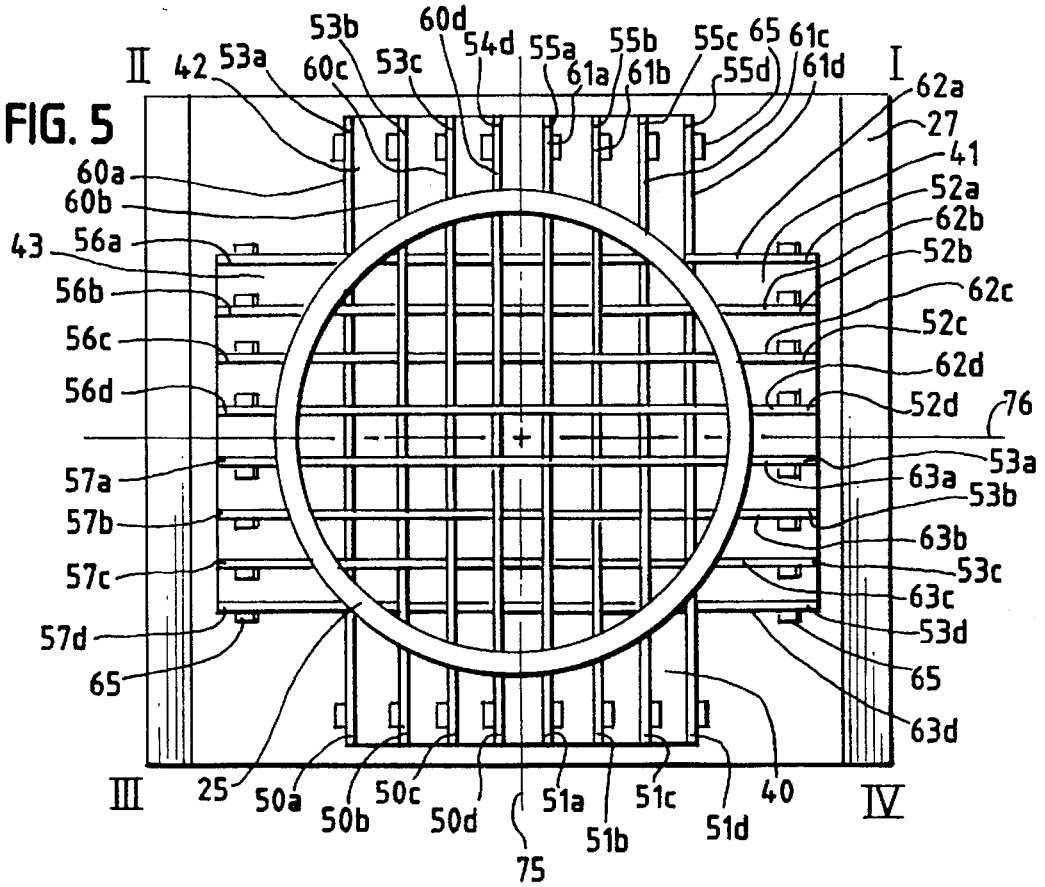
FIG. 5 is an enlarged, top plan view of the slicing apparatus.

Referring to FIGS. 1, 2 and 5, slicing apparatus 20 further comprises four mounting posts 40–43, which are located equiangularly about tube 25 and preferably are welded thereto. In the particular embodiment depicted, posts 40 and 42 are identical and posts 41 and 43 are identical. Each mounting post has opposed, stepped sides for mounting the blades in a staggered arrangement as will be described. The four mounting posts have eight sets of surfaces 50*a–d* to 57*a–d* respectively adjacent to slits 30*a–d* to 37*a–d*. In each surface is a threaded hole 44.

Slicing apparatus 20 further comprises four sets of blades 60*a–d* to 63*a–d*. Blades 60*a–d* extend through slits 30*a–d* and 34*a–d*, respectively, and are mounted on surfaces 50*a–d* and 54*a–d*, respectively. Blades 61*a–d* extend through slits 31*a–d* and 35*a–d*, respectively, and are attached to surfaces 51*a–d* and 55*a–d*, respectively. Blades 62*a–d* extend through slits 32*a–d* and 36*a–d*, respectively, and are attached to surfaces 52*a–d* and 56*a–d*, respectively. Blades 63*a–d* extend through slits 33*a–d* and 37*a–d*, respectively, and are attached to surfaces 53*a–d* and 57*a–d*, respectively. Screws 65 attach the blades into holes 44.

Blades 60*a–d* and 61*a–d* lie in planes parallel to each other and parallel to axis 26. Blades 62*a–d* and 63*a–d* lie in planes parallel to each other and parallel to axis 26. The planes of blades 62*a–d* and 63*a–d* are perpendicular to the planes of blades 60*a–d* and 61*a–d*.

Figure 3:
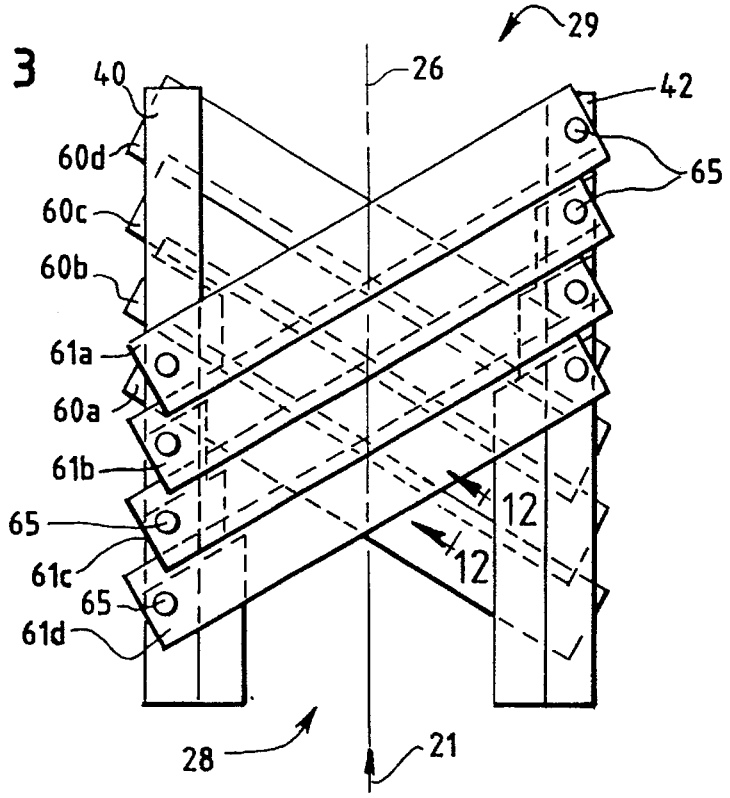
FIG. 3 is an elevational view of the slicing apparatus taken along the line 3—3, but with the tube, the facing mounting post and the blades attached to such facing mounting post not shown.
Figure 4:
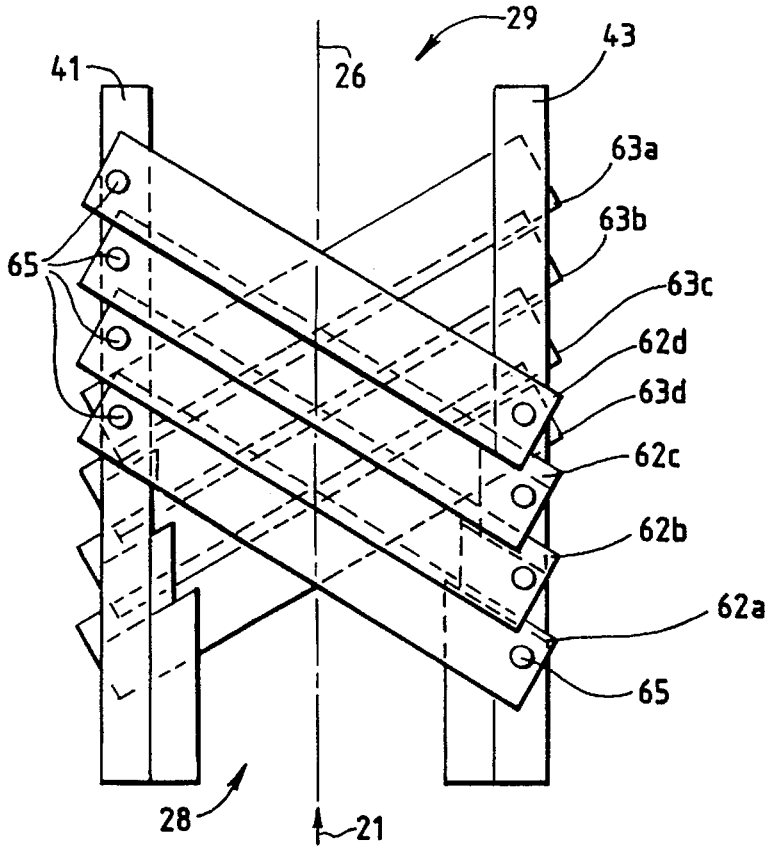
FIG. 4 is an elevational view of the slicing apparatus taken along the line 4—4, but with the tube, the facing mounting post and the blades attached to such facing mounting post not shown.

Each blade is at an acute angle with respect to axis 26. In an actual embodiment, that angle was 60° (30° to a plane perpendicular to axis 26). Referring to FIG. 3, all of blades 60*a–d* are parallel to each other and are at an angle of +60° with respect to axis 26. All of blades 61*a–d* are parallel and are at an angle of −60° to axis 26. Referring to FIG. 4, all four blades 62*a–d* are parallel and are at an angle of +60° to axis 26 and blades 63*a–d* are at an angle of −60° to axis 26. The angle of the blades is determined by the relationship of the slits and the location of the holes on the posts. For example, referring to FIG. 7, slit 30*a* is closer to upstream end 28 and slit 34*a* is closer to downstream end 29.

Figure 10:
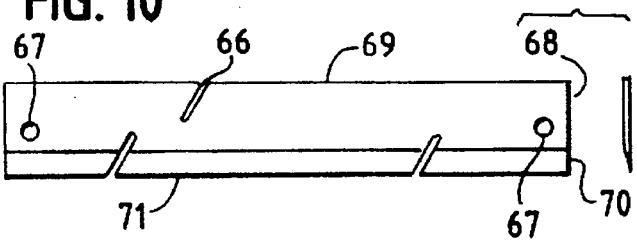
FIG. 10 is a plan view of one of the blades.
Figure 11:
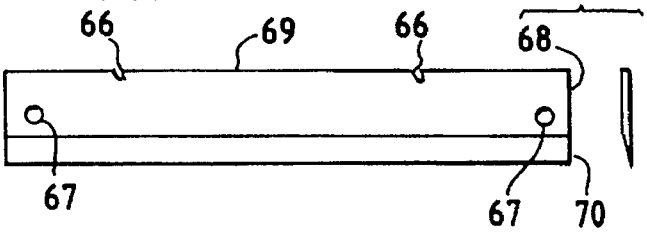
FIG. 11 is a plan view of another one of the blades.

As is best seen in FIG. 1, at the upstream end 28, blades 61*d* and 63*d* intersect, blades 61*c* and 63*c* intersect, 61*b* and 63*b* intersect and blades 61*a* and 63*a* intersect. There are additional intersections of the blades with respect to each other by virtue of notches in them. Thus, referring to FIGS. 10 and 11, each blade includes one or more slots 66 at various locations and depths to accommodate its intersection with other blades. Each blade also has mounting holes 67 through which screws 65 pass into the surfaces of the mounting posts.

Each blade includes a trailing portion 68 terminating in a trailing edge 69, and a leading portion 70 terminating into a leading edge 71 which is sharpened.

Referring to FIG. 5, phantom lines 75 and 76 divide the blade array into four quadrants I–IV. In quadrant I, all of blades 61*a–d* and 62*a–d* are angled in the same direction, that is, toward downstream end 29. Similarly, in quadrant II, all of blades 60*a–d* and 62*a –d* are angled in the same direction, that is, toward upstream end 28. In quadrant III, all of blades 60*a–d* and 63*a–d* are angled in the same direction, that is, toward downstream end 29. In quadrant IV, all of blades 61*a–d* and 63*a–d* are angled in the same direction, that is, toward upstream end 28.

Figure 8:
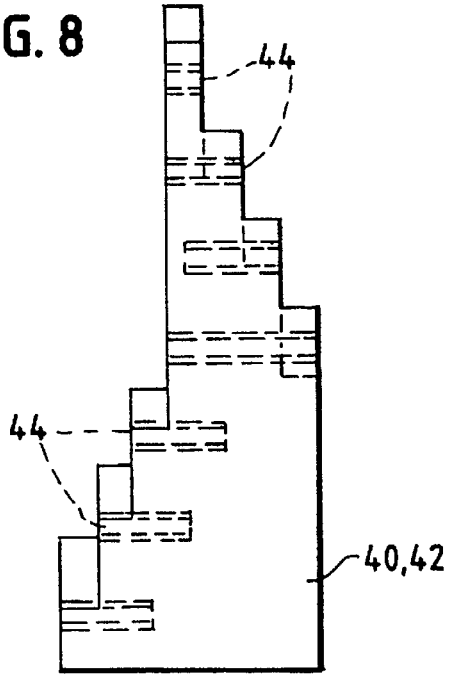
FIG. 8 is a front elevational view of one of the two types of mounting posts.
Figure 9:
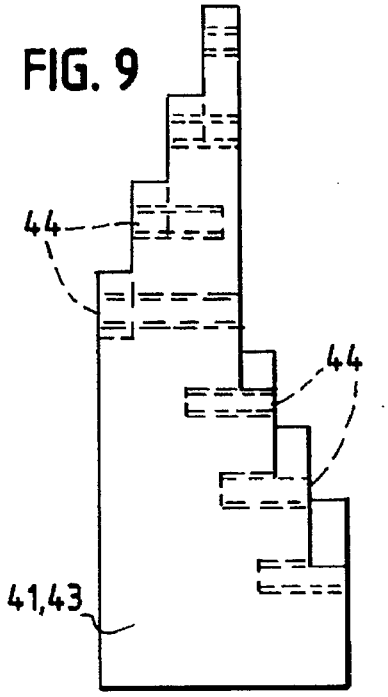
FIG. 9 is an elevational view of the other of the two types of mounting posts.

Posts 41 and 43 depicted in FIG. 9 and posts 40 and 42 depicted in FIG. 8 are slightly different. They all have the same number of staggered steps. However, the surfaces and the holes in posts 41 and 43 are slightly offset from the surfaces and the holes in posts 40 and 42. As a result, blade 63*d* is slightly downstream of blade 61*d*, for example.

The effect is that blades intersect each other all over the cutting area. Even though all the blades are slanted, there is no region of the cutting area where blades do not intersect. This is an important feature of the present invention. It minimizes the tendency of the potato being cut from veering from a path along axis 26. Therefore, this feature enables more perfectly cut potato strips.

Also, a large number of blade intersections rigidifies the entire slicing apparatus to minimize flexing of the blades and resultant distortion of the cut potatoes.

All of the blades are symmetrical about axis 26, so that the forces acting on a potato passing therethrough are balanced and, thereby to minimize the tendency of the blades to move the potato away from such axis.

Figure 12:
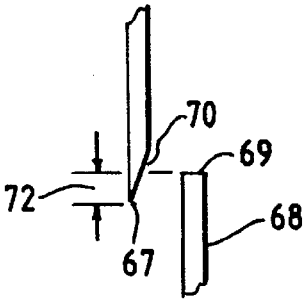
FIG. 12 is an enlarged view in section taken along the line 12—12 of FIG. 3.

Referring to FIG. 12, another feature of the present invention is that the blades overlap. Each pair of adjacent blades is arranged such that leading portion 70 overlaps trailing portion 68. In an operating embodiment of the present invention, the amount 72 of overlap was 4 mm. Preferably, this overlap exists in each pair of adjacent blades that extends in the same direction. Thus, for example, referring to FIG. 4, blades 63*a* and *b* overlap, blades 63*b* and 63*c* overlap and blades 63*c* and 63*d* overlap. The same may be said of adjacent pairs of blades in the other three sets. It would not apply to blades angled in opposite directions. Thus, for example, the term "overlap" would not be descriptive of adjacent blades 63*a* and 62*d*, nor blades 61*a* and 60*d*.

Overlap tends to reduce what is called "shatter." When a potato or other vegetable is moved against a blade, the blade does not cut the vegetable in the sense that it always is in contact with the forward edge of the cut. Rather, after initial contact of the cutting edge with the vegetable, the product is actually split or separated slightly ahead of the edge because of the stress in the vegetable due to the existence of the blade therein. Thus, although the blades are thin, the vegetable being cut is deformed around the bevel of the blade and is thus distorted. The distortion causes stress in the cut potato transversely to the blade. Fracture occurs transversely to this direction and in the plane of the cut. These stress fractures tend to promote breakage of the vegetable as it moves through the blade.

Figure 13:
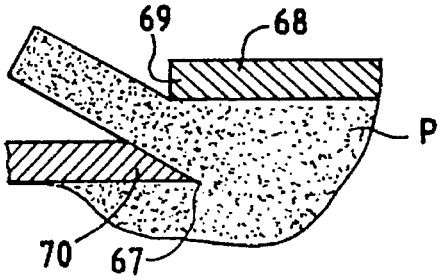
FIG. 13 is a view like FIG. 12 except showing a potato in place.

Overlapping tends to reduce the transverse fracturing phenomenon. Referring to FIG. 13, trailing portion 68 of one blade tends to constrain the portion of the potato P against the leading portion 70 of the adjacent blade. Thus, as the potato is being cut, the tendency of the edge to split is reduced because trailing portion 68 constrains the potato and prevents it from doing so.

Figure 14:
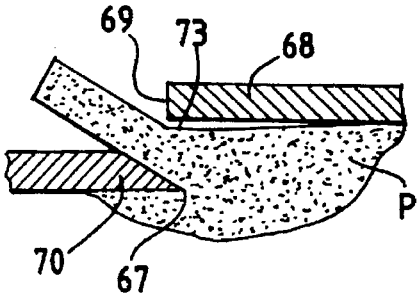
FIG. 14 is a view like FIG. 13 depicting a modification.

An alternative embodiment is depicted in FIG. 14 where the amount of overlap is reduced, say to 2 mm, but a rib 73 is added to trailing portion 68. Such rib increases the pressure on the portion of the potato at the cutting edge and increases its ability to constrain the potato.

Another important feature of the prevent invention is the use of tube 25 which restricts lateral movement of the water in which the potatoes are entrained. Any such lateral movement tends to divert the potato from its preferred orientation in which its longitudinal axis is aligned with cylinder axis 26. Tube 25 guides the potato along axis 26 by precluding lateral movement of both the water and the potato.

The present invention, as depicted in the drawings, is designed to accommodate potatoes having a cross dimension of less than 90 mm. Apparatus 20 has eight blades in one set of parallel planes and another set of eight blades in planes perpendicular to the first set. To accommodate smaller potatoes, a tube of 70 mm. ID or cross dimension can be employed along with two sets of six blades each, in which event the potato strips would still have a cross dimension of 10 mm.

While there have been described two embodiments of the present invention, it is to be understood that variations can be made therein without departing from the spirit and scope of the invention which is defined by the appended claims.

What is claimed is:

1. A food slicing apparatus for potatoes into strips, the potatoes moving through said apparatus along a predetermined path, said apparatus comprising a thin-wall tube having an inner diameter to accommodate the potatoes passing therethrough and having an axis substantially collinear with the predetermined path, a plurality of elongated first blades at an acute angle to said path, said first blades lying in substantially parallel first planes, and a plurality of elongated second blades at an acute angle to said path, said second blades lying in substantially parallel second planes substantially perpendicular to said first planes, each of said blades having leading an trailing portions and each of said leading portions terminating in a sharpened leading edge, the leading and tailing portions of at least one pair of adjacent ones of said blades overlapping, wherein said tube guides the potatoes along the axis substantially collinear with the predetermined path and blade support means located outside of and separate from said tube, said blades passing through said tube and being attached to said blade-support means.

2. A food slicing apparatus for slicing vegetables into strips, the vegetables moving through said apparatus along a predetermined path, said apparatus comprising a thin-wall tube having an inner diameter to accommodate the vegetables passing therethrough and having an axis substantially collinear with the predetermined path, a plurality of elongated first blades at an acute angle to said path, said first blades lying in substantially parallel first planes, a plurality of elongated second blades at an acute angle to said path, said second blades lying in substantially parallel second planes substantially perpendicular to said first planes, each of said blades having leading and trailing portions and each of said leading portions terminating in a sharpened leading edge, the leading and trailing portions of at least one pair of adjacent ones of said blades overlapping wherein said tube guides the vegetables along the axis substantially collinear with the predetermined path and blade support means located outside of and separate from said tube, said blades passing through said tube and being attached to said blade-support means.

3. A food slicing apparatus for slicing potatoes into strips, the potatoes moving through said apparatus along a predetermined path, said apparatus comprising a thin-wall tube having an inner diameter to accommodate the potatoes passing therethrough and having an axis substantially collinear with the predetermined path, a set of elongated first blades at a first acute angle to said path, a set of elongated second blades at a second acute angle to said path, said first and second blades lying in substantially parallel first planes, a set of elongated third blades at a third acute angle to said path, a set of elongated fourth blades at a fourth acute angle to said path, said third and fourth blades lying in substantially parallel second planes substantially perpendicular to said first planes, wherein said tube guides the potatoes along the axis substantially collinear with the predetermined path and blade support means located outside of and separate from said tube, said blades passing through said tube and being attached to said blade-support means.

4. The food slicing apparatus of claim 3, wherein each of said blades has leading and trailing portions and each of said leading portions terminates in a sharpened leading edge, the leading and trailing portions of at least one pair of adjacent ones of said blades overlapping.

5. The food slicing apparatus of claim 4, wherein said first angle is substantially equal to said second angle, but of opposite polarity, and said third angle is substantially equal to said fourth angle, but of opposite polarity.

6. The food slicing apparatus of claim 4, further comprising support means outside said tube and secured thereto, said blades being removably attached to said support means.

7. A food slicing apparatus for slicing vegetables into strips, the vegetables moving through said apparatus along a predetermined path, said apparatus comprising a thin-wall tube having an inner diameter to accommodate the vegetables passing therethrough and having an axis substantially collinear with the predetermined path, a set of elongated first blades at a first acute angle to said path, a set of elongated second blades at a second acute angle to said path, said first and second blades lying in substantially parallel first planes, a set of elongated third blades at a third acute angle to said path, a set of elongated fourth blades at a fourth acute angle to said path, said third and fourth blades lying in substantially parallel second planes substantially perpendicular to said first planes, and blade-support means outside of and separate from said tube, said blades passing through said tube and being removably attached to said blade-support means, wherein said tube guides the vegetables along the axis substantially collinear with the predetermined path.

8. The food slicing apparatus of claim 7, wherein each of said blades has leading and trailing portions and each of said leading portions terminates in a sharpened leading edge, the leading and trailing portions of at least one pair of adjacent ones of said blades overlapping.

9. The food slicing apparatus of claim 8, wherein said first angle is substantially equal to said second angle, but of opposite polarity, and said third angle is substantially equal to said fourth angle, but of opposite polarity.

10. The food slicing apparatus of claim 8, wherein said tube has slits through which said blades extend.

11. The food slicing apparatus of claim 8, wherein said support means includes four posts disposed equiangularly about said post, each tube having stepped sides, said blades being removably secured to said sides.

12. The food slicing apparatus of claim 8, further comprising a base attached to said tube.

13. A food slicing apparatus for slicing vegetables into strips, the vegetables moving through said apparatus along a predetermined path, said apparatus comprising a thin-wall tube having an inner diameter to accommodate the vegetables passing therethrough and having an axis substantially collinear with the predetermined path, a set of elongated first blades at a first acute angle to said path, a set of elongated second blades at a second acute angle to said path, said first and second blades lying in substantially parallel first planes, a set of elongated third blades at a third acute angle to said path, a set of elongated fourth blades at a fourth acute angle to said path, said third and fourth blades lying in substantially parallel second planes substantially perpendicular to said first planes, wherein said tube guides the vegetable along the axis substantially collinear with the predetermined path and blade support means located outside of and separate from said tube, said blades passing through said tube and being attached to said blade-support means.

14. The food slicing apparatus of claim 13, wherein said tube has slits through which said blades extend.

15. The food slicing apparatus of claim 13, wherein each of said blades has leading and trailing portions and each of said leading portions terminates in a sharpened leading edge, the leading and trailing portions of at least one pair of adjacent ones of said blades overlapping.

16. The food slicing apparatus of claim 13, wherein said blades are secured to said support means by screws.

17. The food slicing apparatus of claim 13, wherein said support means includes four posts disposed equiangularly about said post, each tube having stepped sides, said blades being removably secured to said sides.

18. The food slicing apparatus of claim 13, and further comprising a base attached to said tube.

19. The food slicing apparatus of claim 13, wherein each of said angles is about 60°.

20. The food slicing apparatus of claim 13, wherein the trailing portion of one of said overlapping blades further comprises a rib.

* * * * *